US011524505B2

(12) United States Patent
Hokazono

(10) Patent No.: US 11,524,505 B2
(45) Date of Patent: Dec. 13, 2022

(54) INK JET RECORDING DEVICE AND RECORDING MEDIUM TEMPERATURE CONTROL METHOD

(71) Applicant: Konica Minolta, Inc., Tokyo (JP)

(72) Inventor: Yutaka Hokazono, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 2 days.

(21) Appl. No.: 17/359,925

(22) Filed: Jun. 28, 2021

(65) Prior Publication Data

US 2022/0001674 A1 Jan. 6, 2022

(30) Foreign Application Priority Data

Jul. 1, 2020 (JP) ..... JP2020-113700

(51) Int. Cl.
*B41J 2/175* (2006.01)
*B41J 11/00* (2006.01)

(52) U.S. Cl.
CPC ..... *B41J 2/17593* (2013.01); *B41J 11/002* (2013.01)

(58) Field of Classification Search
CPC ..... B41J 2/17593; B41J 11/002; B41J 11/00212; B41J 11/00214; B41J 11/00216; B41J 29/38
See application file for complete search history.

(56) References Cited

U.S. PATENT DOCUMENTS

2021/0070067 A1* 3/2021 Edamura ..... G06K 15/16

FOREIGN PATENT DOCUMENTS

WO 2013165003 A1 11/2013

* cited by examiner

*Primary Examiner* — Bradley W Thies
(74) *Attorney, Agent, or Firm* — Cantor Colburn LLP

(57) ABSTRACT

An ink jet recording device includes the following. A conveyor conveys a recording medium. A recording operator ejects an ink to cause the ink to land on the recording medium in a middle of a conveyance path of the recording medium conveyed by the conveyor. A reverser returns the recording medium from a first position downstream of a landing position of the ink, which is ejected from the recording operator, to a second position upstream of the landing position along the conveyance path. A first temperature regulator that regulates a temperature of the recording medium in at least a part of a region from the second position to the landing position on the conveyance path. A hardware processor causes the recording operator not to eject the ink while the recording medium initially passes through the landing position.

11 Claims, 5 Drawing Sheets

FIG.3

| PAPER THICKNESS LEVEL | FORWARD PLACEMENT | NON-RECORDING TURN | UV IRRADIATION |
|---|---|---|---|
| 1 (THIN) | OFF | NO | OFF |
| 2 | ON | NO | OFF |
| 3 | ON | ONE TIME | OFF |
| 4 | ON | ONE TIME | ON |
| 5 (THICK) | ON | TWO TIMES | ON |

FIG.4A

| DRUM SURFACE | HEATING | RECORDING |
|---|---|---|
| A | 1 | |
| B | | |
| C | 2 | |
| A | | |
| B | 3 | |
| C | | 1 |
| A | 4 | |
| B | | 2 |
| C | 5 | |
| A | | 3 |
| B | 6 | |
| C | | 4 |
| A | 7 | |
| B | | 5 |
| C | 8 | |
| A | | 6 |
| B | 9 | |
| C | | 7 |

FIG.4B

| DRUM SURFACE | HEATING | RECORDING ON FRONT SIDE | RECORDING ON BACK SIDE |
|---|---|---|---|
| A | 1 | | |
| B | | | |
| C | 2 | | |
| A | | | |
| B | 3 | | |
| C | | 1 | |
| A | 4 | | |
| B | | 2 | |
| C | 5 | | |
| A | | 3 | |
| B | | | 1 |
| C | | 4 | |
| A | | | 2 |
| B | | 5 | |
| C | | | 3 |
| A | 6 | | |
| B | | | 4 |
| C | 7 | | |
| A | | | 5 |
| B | 8 | | |
| C | | 6 | |
| A | 9 | | |
| B | | 7 | |
| C | 10 | | |

INK JET RECORDING DEVICE AND RECORDING MEDIUM TEMPERATURE CONTROL METHOD

CROSS-REFERENCE TO RELATED APPLICATIONS

The present invention claims priority under 35 U.S.C. § 119 to Japanese Patent Application No. 2020-113700 filed on Jul. 1, 2020, entire content of which is incorporated herein by reference.

BACKGROUND

Technological Field

The present invention relates to an ink jet recording device and a recording medium temperature control method.

Description of the Related Art

There is an ink jet recording device that ejects ink onto a recording medium to record an image, a structure, or the like. The ink can be fixed to various types of recording mediums, but, depending on ink, the control of the temperature of the ink may be important in obtaining a proper fixed state.

There is a technique of controlling not only the temperature of the ink at the time of ejection but also the temperature of the recording medium which greatly affects the fixing of the ink after the ink has landed on the recording medium. WO 2013/165003 A discloses a technique by which a heater is provided to appropriately maintain the temperature of a recording medium even when images are recorded on both sides of the recording medium.

SUMMARY

However, depending on the thermal conductivity, the thickness, or the like of the recording medium, the temperature of the recording medium cannot be raised to an appropriate temperature even when heating is started immediately before the start of a recording operation, and a very large heating mechanism with high power consumption is required to rapidly raise the temperature to the appropriate temperature, which is a problem.

An object of the invention is to provide an ink jet recording device and a recording medium temperature control method capable of appropriately controlling the temperature of a recording medium more conveniently and flexibly during image recording.

To achieve at least one of the abovementioned objects, according to an aspect of the present invention, an ink jet recording device reflecting one aspect of the present invention includes, a conveyor that conveys a recording medium; a recording operator that ejects an ink to cause the ink to land on the recording medium in a middle of a conveyance path of the recording medium conveyed by the conveyor; a reverser that returns the recording medium from a first position downstream of a landing position of the ink, which is ejected from the recording operator, to a second position upstream of the landing position along the conveyance path; a first temperature regulator that regulates a temperature of the recording medium in at least a part of a region from the second position to the landing position on the conveyance path; and a hardware processor, wherein the hardware processor causes the recording operator not to eject the ink while the recording medium initially passes through the landing position.

According to another aspect, a recording medium temperature control method of an ink jet recording device including a conveyor that conveys a recording medium, a recording operator that ejects an ink to cause the ink to land on the recording medium in a middle of a conveyance path of the recording medium conveyed by the conveyor, a reverser that returns the recording medium from a first position downstream of a landing position of the ink, which is ejected from the recording operator, to a second position upstream of the landing position along the conveyance path, and a first temperature regulator that regulates a temperature of the recording medium in at least a part of a region from the second position to the landing position on the conveyance path, the method including: temperature regulating of causing the recording operator not to eject the ink while the recording medium initially passes through the landing position.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein:

FIG. 3 is a table showing heating operation level settings;

FIG. 4A and FIG. 4B are tables showing the sequence of placement of recording mediums on an image recording drum when non-recording turns are performed.

DETAILED DESCRIPTION OF THE EMBODIMENTS

Hereinafter, one or more embodiments of the present invention will be described with reference to the drawings. However, the scope of the invention is not limited to the disclosed embodiments.

Hereinafter, the embodiments of the invention will be described with reference to the drawings.

Figure 1:
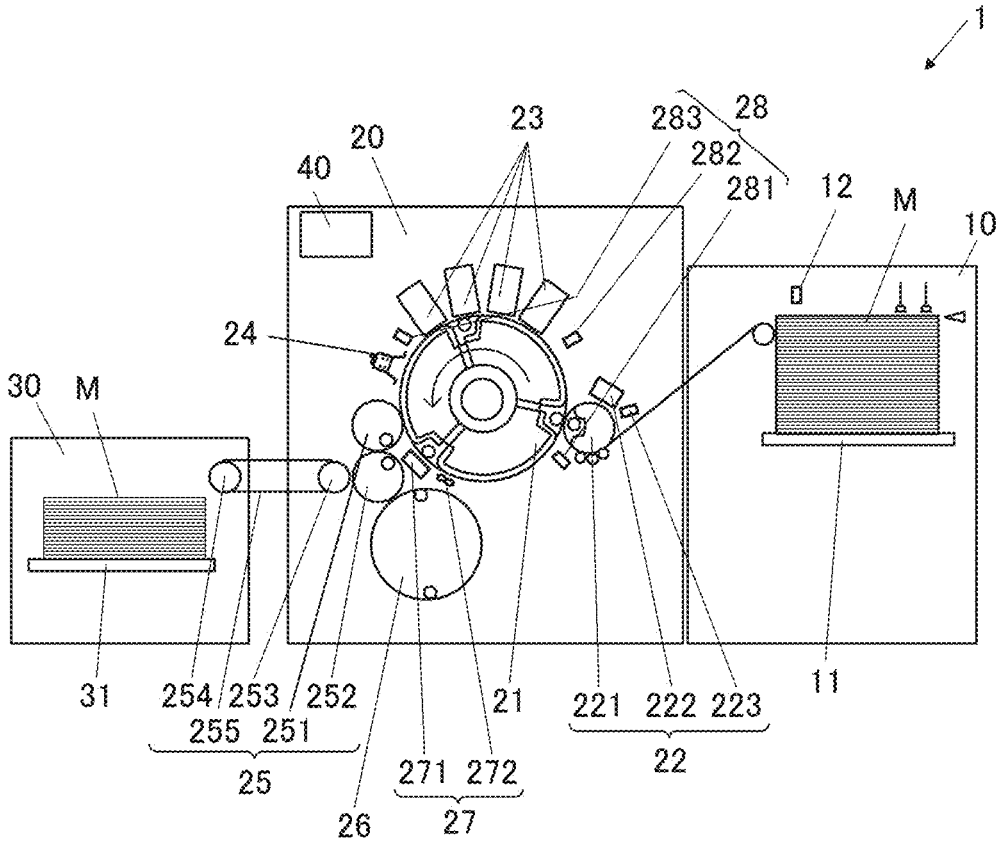
FIG. 1 is a schematic view illustrating the entire configuration of an ink jet recording device of the present embodiment.

FIG. 1 is a schematic view illustrating the entire configuration of an ink jet recording device 1 of the present embodiment.

A front view of the ink jet recording device 1 is illustrated.

The ink jet recording device 1 of the present embodiment includes a medium feeder 10, an image recorder 20, a medium discharger 30, a hardware processor 40, and the like. In the ink jet recording device 1, according to control by the hardware processor 40, a recording medium M stored in the medium feeder 10 is conveyed to the image recorder 20, an image is recorded on the recording medium M, and then the recording medium M is discharged to the medium discharger 30.

The medium feeder 10 sends the recording mediums M, which are stored thereinside, to the image recorder 20 one by one.

As the recording medium M, various recording mediums of various thicknesses or qualities are used such as printing paper, various types of resin base materials (for example, polypropylene (PP) and polyethylene terephthalate (PET)) in the forms of cells, films, and boards, fabrics, and the like.

The medium feeder 10 includes a feed tray 11 that stores the recording mediums M, and a feed temperature meter 12. The feed tray 11 is a plate-shaped member which is provided such that one or a plurality of the recording mediums M can be placed therein. The feed tray 11 is provided to move upward and downward according to the amount of the recording mediums M placed in the feed tray 11, and the recording medium M located uppermost in the direction of the upward and downward movement is held at the position of being sent to the image recorder 20.

The feed temperature meter 12 measures the temperature of a front surface of the recording medium M, which is located uppermost on the feed tray 11, to output the measured temperature to the hardware processor 40. The feed temperature meter 12 may be a non-contact type, for example, an infrared thermometer.

The image recorder 20 includes an image recording drum 21 (first placement member), a forwarder 22, a head unit 23 (recording operator), an irradiator 24, a deliverer 25, a reverser 26, a main temperature regulator 27 (first temperature regulator), a main meter 28, and the like.

The image recording drum 21 has a cylindrical outer shape, can carry (place) a total of three recording mediums M each one at every 120 degrees on an outer peripheral surface of a cylindrical portion, and performs a conveyance operation of conveying the recording mediums M (moving a placement surface along a conveyance path) according to the operation of rotation around a central axis of the cylinder. The temperature of the outer peripheral surface of the image recording drum 21 is regulated by the main temperature regulator 27.

The main temperature regulator 27 includes a drum heater 271 and a fan 272, and the temperature of the outer peripheral surface (front surface) of the image recording drum 21 is regulated by the operation thereof. The drum heater 271 heats the outer peripheral surface, and the fan 272 promotes heat dissipation from the outer peripheral surface. The temperature to be regulated may be determined according to a temperature appropriate at the time of landing of an ink. The main temperature regulator 27 performs heating and heat dissipation on the outer peripheral surface outside a placement section from a conveyance start position (second position) where the recording medium M is to be placed to a conveyance end position (first position) where the recording medium M which is placed is to be removed (conveyance path of the recording medium M conveyed by the image recording drum 21) in a rotation direction of the image recording drum 21. The recording medium M carried on the image recording drum 21 is heated (temperature is regulated) from the outer peripheral surface of the image recording drum 21 in a section including a region from the second position where the recording medium M is placed to a position facing the head unit 23 (ink landing position) (at least a part from the second position to the landing position), and the ink ejected from each of nozzles of the head unit 23 at the landing position lands at an appropriate position on a surface (one target recording surface) of the recording medium M opposite to a surface that is in contact with the image recording drum 21, so that an image or the like is recorded.

The forwarder 22 is delivered the recording medium M from the medium feeder 10 on an upstream side of the image recording drum 21 (second position) to deliver the recording medium M to the image recording drum 21. The forwarder 22 includes a delivery drum 221 (second placement member) that has a cylindrical shape and carries (places) the recording medium M; a forward heater 222 (second temperature regulator) that heats the delivery drum 221; a forward temperature meter 223 that measures the temperature of the front surface of the delivery drum 221; and the like.

In the present embodiment, the image recording drum 21 and the delivery drum 221 form a conveyor that conveys the recording medium M.

The head unit 23 ejects ink droplets onto the one target recording surface of the recording medium M, which moves in the middle of the conveyance path according to the rotation of the image recording drum 21, from a plurality of nozzle openings at an appropriate timing, the plurality of nozzle openings being provided in a surface (nozzle surface) of the head unit 23 facing the target recording surface of the recording medium M, and the ink droplets land on the target recording surface, so that an image is recorded. The head unit 23 includes one or a plurality of recording heads, each of which is provided with a plurality of the nozzles. In the ink jet recording device 1 of the present embodiment, a plurality of the head units 23, here, four head units 23 are arranged at predetermined intervals in a conveyance direction of the recording medium M to correspond to inks of four colors. The four head units 23 output respective cyan (C), magenta (M), yellow (Y), and black (K) inks. The order of arrangement of the head units 23 may be appropriately determined. As the inks, inks are used which are cured by being irradiated with electromagnetic waves having a predetermined wavelength, here, ultraviolet rays as active energy rays. The temperature of the ink may be maintained by heating by an ink heater or the like not illustrated.

Each of the head units 23 includes a line head that includes the plurality of nozzle openings arranged over the image recording width of the recording medium M in a width direction perpendicular to the conveyance direction of each of the recording mediums M conveyed on the image recording drum 21, and can record an image by a single path method in which the ink is ejected from the nozzle openings onto the recording medium M while the recording medium M moves in the conveyance direction. The head units 23 are attached to a support portion (carriage) not illustrated.

The irradiator 24 irradiates the ink, which has been ejected from the head units 23 and has landed on the recording medium M, with energy rays (ultraviolet rays) to cause a reaction of curing the inks, and thus fixes the inks. The irradiator 24 includes, for example, light emitting diodes (LED's) that emit ultraviolet rays, and performs irradiation of ultraviolet rays in such a manner that a voltage is applied to the LED's to cause current to flow therethrough and thus the LED's emit light. The irradiator 24 is provided to be able to irradiate the ink, which has landed on the recording medium M, with ultraviolet rays before the recording medium M reaches the deliverer 25 (namely, a position downstream of the landing position and upstream of the first position) after the ink has been ejected from the head unit 23 onto the recording medium M, the recording medium M being conveyed by the rotation of the image recording drum 21. If necessary, the irradiator 24 may include a light shielding wall or the like which blocks ultraviolet rays from leaking outside a desired irradiation range.

The configuration of the irradiator 24 which emits ultraviolet rays is not limited to the LED. The irradiator 24 may include, for example, a mercury lamp. When ink has properties of being cured and fixed when receiving active energy rays other than ultraviolet rays, the irradiator 24 may include a known emission source (light source) that emits active energy rays for curing the ink, instead of the above-described configuration of emitting ultraviolet rays. Since a large amount of heat is also dissipated due to the irradiation of ultraviolet rays, and the dissipated heat is transmitted to the recording medium M or the image recording drum 21, the irradiator 24 heats the recording medium M or the image recording drum 21. When heating is not required, the LED's may be lighted up only in a range in which the curing of the inks is required, and lighted off in other periods.

The deliverer 25 acquires the recording medium M, on which the image has been recorded and the recorded image (inks) has been fixed, from the image recording drum 21 at an end point (first position downstream of the ink landing position along the conveyance path) of the conveyance path of the recording medium M conveyed by the image recording drum 21, and conveys the recording medium M to the medium discharger 30. The deliverer 25 includes a discharge selecting roller 251 having a cylindrical shape; a delivery roller 252; a plurality (for example, two) of rollers 253 and 254; a belt 255 which has a ring shape and of which the inner surface is supported by the rollers 253 and 254; and the like.

The discharge selecting roller 251 switches between discharging the recording medium M to the medium discharger 30 and returning the recording medium M to a feed side (second position upstream of the ink landing position) of the recording medium M again. The delivery roller 252 receives the recording medium M, which is to be discharged to the medium discharger 30, from the discharge selecting roller 251 to guide the recording medium M onto the belt 255. The deliverer 25 conveys and sends the recording medium M to the medium discharger 30 by causing the recording medium M, which has been delivered from the delivery roller 252 onto the belt 255, to move with the belt 255 which moves in a circle as the rollers 253 and 254 rotate.

The reverser 26 receives the recording medium M, which is not yet discharged to the medium discharger 30 among the recording mediums M delivered from the image recording drum 21 to the deliverer 25 at the conveyance end position, from the discharge selecting roller 251, and returns and places the recording medium M to and on the image recording drum 21 at a position upstream of the ink landing position again, here, at the conveyance start position (second position) where the recording medium M is delivered from the forwarder 22 to the image recording drum 21, or at a position slightly upstream of the conveyance start position. The reverser 26 reverses front and back sides of the recording medium M in which an image is recorded on one surface thereof, and returns the recording medium M to the image recording drum 21, but may be able to return the recording medium M thereto without reversing the recording medium M. When the reverser 26 receives the recording medium M from one of three placeable ranges (A to C) on the image recording drum 21, the reverser 26 returns the recording medium M to a placeable range (A→C, B→A, or C→B), two behind the placeable range.

The main meter 28 includes a drum temperature meter 281 that measures the temperature of the outer peripheral surface of the image recording drum 21 after being heated and caused to dissipate heat by the main temperature regulator 27; a pre-recording temperature meter 282 that measures the temperature of the front surface of the recording medium M before the recording medium M placed at the conveyance start position reaches the ink landing position of the head unit 23; and a post-recording temperature meter 283 that measures the temperature of the front surface of the recording medium M before the recording medium M reaches the range of irradiation by the irradiator 24 after having passed through the ink landing position. Each measurement data of the main meter 28 is output to the hardware processor 40.

The medium discharger 30 stores the recording medium M sent from the image recorder 20 by the deliverer 25, until a user takes out the recording medium M. The medium discharger 30 includes a discharge tray 31 having a plate shape and the like, and the recording mediums M after being subjected to a recording operation are stacked on the discharge tray 31.

The hardware processor 40 controls operations of the medium feeder 10, the image recorder 20, and the medium discharger 30 to cause an image to be recorded on the recording medium M according to data of a target recording image by an image recording command (job) and a setting related to an image recording operation.

Figure 2:
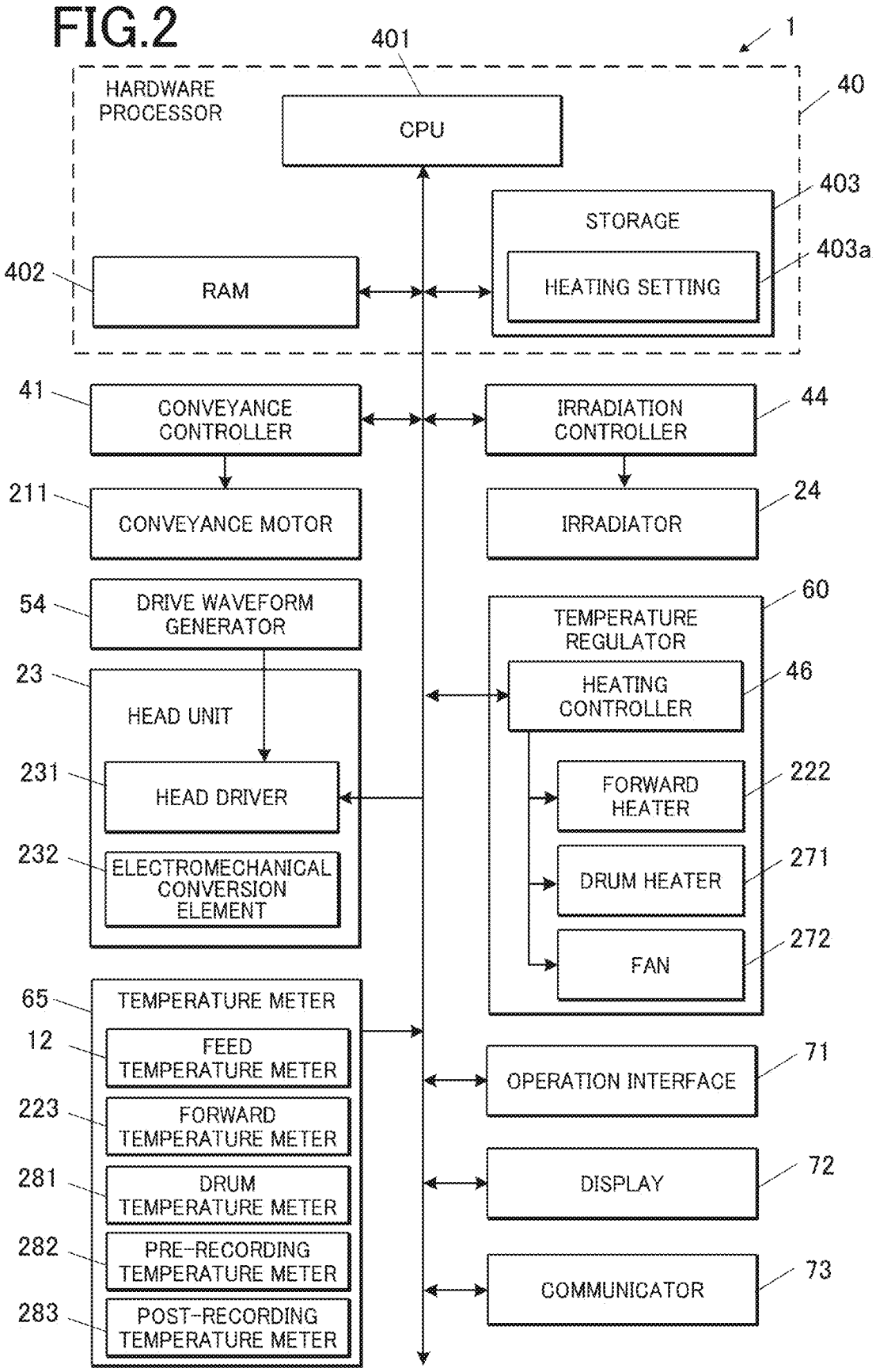
FIG. 2 is a block diagram illustrating a functional configuration of the ink jet recording device.

FIG. 2 is a block diagram illustrating a functional configuration of the ink jet recording device 1.

The ink jet recording device 1 includes conveyance motors 211, a conveyance controller 41, an irradiation controller 44, a drive waveform generator 54, a temperature regulator 60, a temperature meter 65 (meter), an operation interface 71, a display 72, a communicator 73, and the like in addition to the head units 23, the irradiator 24, the hardware processor 40, and the like.

The conveyance motors 211 include motors that drive parts of the medium feeder 10 and the image recorder 20, which operate to move the recording medium M. The conveyance controller 41 causes the conveyance motors 211 to operate at appropriate timings, if necessary, in synchronization with each other.

The head unit 23 includes a head driver 231, electromechanical conversion elements 232, and the like. The head unit 23 of the present embodiment is not particularly limited, and piezoelectric elements (electromechanical conversion elements 232) are provided along an ink flow path (particularly, ink chamber) communicating with the nozzles that eject ink. The head unit 23 includes a piezoelectric type drive mechanism that deforms the piezoelectric element according to a fluctuation in voltage applied to the piezoelectric element to cause a pressure fluctuation in ink and thus ejects the ink from the nozzle. The head driver 231 appropriately outputs a drive signal, which is input from the drive waveform generator 54, to each of the electromechanical conversion elements 232 based on image data of an output target.

The drive waveform generator 54 generates and outputs a drive waveform signal, which is determined in advance, to the head unit 23. The drive waveform generator 54 holds a predetermined number of drive waveform patterns as digital data, converts each digital data into an analog signal according to a clock signal, amplifies the analog signal to an appropriate voltage and current, and outputs the amplified analog signal.

The irradiation controller 44 controls the irradiation timing, the irradiation time, and the irradiation intensity of ultraviolet rays (energy rays) from the irradiator 24. The irradiator 24 emits ultraviolet rays by causing the LED's to emit light based on a control signal from the irradiation controller 44.

The temperature regulator 60 includes the forward heater 222, the main temperature regulator 27, a heating controller 46, and the like. The heating controller 46 performs control of switching between operating and not operating the forward heater 222, the drum heater 271, and the fan 272, based on a setting related to the type of the recording medium M, the results of measurement of the temperature meter 65, and the like, such that the temperatures of the delivery drum 221 and the image recording drum 21 are maintained in a proper temperature range.

The temperature meter 65 includes the feed temperature meter 12, the forward temperature meter 223, the drum temperature meter 281, the pre-recording temperature meter 282, and the post-recording temperature meter 283.

The operation interface 71 receives an input operation by a user or the like from outside, and outputs the input operation to the hardware processor 40 as an input signal. The operation interface 71 includes, for example, a touch panel, a push button switch, and the like. The touch panel may be located to overlap a display screen of the display 72. The operation interface 71 may include other various operation switches and the like.

The display 72 displays various statuses, menus, or the like on the display screen according to control of the hardware processor 40. The display 72 includes, for example, the display screen, light emitting diode (LED) lamps, and the like. The display screen is not particularly limited and is, for example, a liquid crystal display (LCD). Regarding the LED lamps, a lamp for a color and at a position corresponding to each situation is lighted up (including a blinking operation) according to, for example, an electric power supply situation, an abnormality occurrence situation, or the like by the hardware processor 40.

The communicator 73 controls the transmission and reception of data (signal) to and from an external device or the like according to a predetermined communication standard. The communicator 73 controls communication according to, for example, a local area network (LAN) standard. A peripheral device or the like may be connectable to the communicator 73 according to a universal serial bus (USB) standard.

The hardware processor 40 includes a central processing unit (CPU) 401, a random access memory (RAM) 402, a storage 403, and the like. The CPU 401 performs various arithmetic processes to perform a control operation. The RAM 402 provides the CPU 401 with a working memory space, and temporarily stores data. The storage 403 includes a non-volatile memory, and stores various setting data, a program, and the like. The setting data includes a heating setting 403*a*. The heating setting 403*a* is, as will described later, data for adjusting the operation of heating of the recording medium M by each part according to the type of the recording medium or the like. The program includes a control program related to a medium temperature control process to be described later, and the amount of irradiation by the irradiator 24 is changed and controlled such that the ink which has landed on the recording medium M is reliably fixed in an appropriate state (state where the suppression of an adverse impact on the recording medium M or the like is also taken into consideration) according to the situation (landed state) of the recording medium M. The storage 403 includes a large-capacity volatile memory, and may be able to store job data, work data (processing data) of a job, and the like.

The conveyance controller 41, the irradiation controller 44, and the heating controller 46 each may be operated by processors (CPU's or the like) separate from the hardware processor 40, or the CPU 401 may actually perform each process in common.

Next, the heating operation of the recording medium M in the ink jet recording device 1 of the present embodiment will be described.

In the ink jet recording device 1, in order to properly fix a landed ink, the temperature of the recording medium M, particularly, the temperature of an ink landing surface is maintained in an appropriate range. The appropriate temperature range is determined according to the type of the ink, and meanwhile is maintained higher than room temperature in many cases. Therefore, in many cases, the recording medium M is heated at least when an image recording operation is started.

In general, thermal conduction takes time in many cases, particularly, in a recording medium having a low thermal conductivity or a thick recording medium, a recording surface may not be heated to a proper temperature range in a period from the time of placement of the recording medium on the image recording drum 21 to the time of movement of the recording medium to the ink landing position. In the ink jet recording device 1, the heating operation of the recording medium M is adjusted according to the characteristic of the recording medium.

As the heating operation, in addition to normal heating from the conveyance start position to the ink landing position by the drum heater 271, a heating operation is performed by the forward heater 222. In the ink jet recording device 1, the ink is not immediately (while the recording medium M at least initially (for a predetermined number of times) passes through the landing position or until the recording medium M returns from the first position to the second position) ejected from the head unit 23 onto the recording medium M which has reached the ink landing position, namely, the recording medium M moves in a circle without an image being recorded thereon (referred to as a non-recording turn), so that the state where the recording medium M is heated by the image recording drum 21 can be maintained. Heating by heat generated by the irradiator 24 can also be performed by lighting up the LED's of the irradiator 24 when the recording medium M passes therethrough on which the ink has not landed. When the recording medium M which has been returned to the feed side by the reverser 26 is placed and moves in a circle for the second and subsequent times, the ink is ejected and lands thereon, so that an image recording operation can be performed at an appropriate temperature of the recording medium M.

FIG. 3 is a table showing heating operation level settings.

Heating levels are adjusted and controlled in which the operation of the forward heater 222, the number of non-recording turns (predetermined number of times), and the operation of the irradiator 24 are combined in five stages in which the thickness of the recording medium M (referred to as a paper thickness, but not limited to the paper as described above) as a characteristic thereof is used as an index. In paper thickness level 1, neither heating by the forward heater 222, heating during non-recording turn, nor heating by the irradiator 24 is performed, and only normal heating by the drum heater 271 is performed. In paper thickness level 2, heating by the forward heater 222 is added. Namely, in the paper thickness levels 1 and 2, the recording medium M is conveyed and an image recording operation by the head unit 23 is performed thereon as usual.

In the case of paper thickness level 3, non-recording turns are executed in addition to the setting of the paper thickness level 2. An image recording operation is not performed when the recording medium M initially passes through the ink landing position after placement on the image recording drum 21, and the recording medium M is returned from the conveyance end position to the conveyance start position via the reverser 26. When the recording medium M passes through the ink landing position on the image recording drum 21 during a second lap of the movement, the ink is ejected from the head unit 23 onto the recording medium M to record an image. In this case, the output speed of the recorded image decreases by the length of time of execution of the non-recording turn.

In paper thickness level 4, heating by the lighting up of the LED's of the irradiator 24 is further added in addition to the setting of the paper thickness level 3. Since the ink is not ejected, irradiated ultraviolet rays themselves basically do not affect an image recording operation on the recording medium M. The output speed of a recorded image is not changed from that in the paper thickness level 3. Since the existing configuration is used, it is not required to increase the maximum heating (electric power capacity or the like) of the drum heater 271 for heating. Only whether or not lighting is performed (irradiation of ultraviolet rays) is determined to be controlled, but the lighting time and/or the lighting intensity may be determined. The irradiator 24 may be lighted up not only during passing of the recording medium M but also before passing to warm air in a space inside the light shielding wall in advance.

In paper thickness level 5, the number of non-recording turns in the setting of the paper thickness level 3 is changed to 2.

The heating of the recording medium M is also affected by the quality (thermal conductivity) of the medium or the temperature (temperature measured by the feed temperature meter 12) of the recording medium M before being fed to the image recorder 20 in addition to the thickness. Therefore, the paper thickness level which serves as a reference (as a setting condition) may be changed by a predetermined level to be set according to the type of the medium (a high quality paper, a plain paper, a coated paper, a non-coated paper, the type of a resin, or the like) and a pre-feeding temperature (or a difference between the pre-feeding temperature and a target temperature). Namely, in the recording medium M having a low thermal conductivity or the recording medium M having a low pre-feeding temperature, a heating operation of a level higher by a predetermined stage (for example, one stage) than the level determined by the paper thickness may be selected, and in the recording medium M having a high thermal conductivity or the recording medium M having a high pre-feeding temperature, a heating operation of a level lower by a predetermined stage (for example, one stage) than the level determined by the paper thickness may be selected.

FIG. 4A and FIG. 4B are tables showing the sequence of placement of the recording mediums M on the image recording drum 21 when non-recording turns are performed.

When the image recording drum 21 has the three placeable ranges A, B, and C in the rotation direction, in a normal single-sided recording operation, three images can be output when the image recording drum 21 rotates one turn. Meanwhile, when one non-recording turn is inserted, as illustrated in FIG. 4A, for example, the recording mediums are to be fed to placeable ranges every other time, and heating is performed during the non-recording turn (temperature regulation step). The front and back sides of the recording medium M heated during the non-recording turn are reversed by the reverser 26 or the like, and then the recording medium M is placed in a placeable range, two behind the placeable range, and is conveyed. Since the placeable range is at a fifth placeable position which passes through the conveyance start position after the placement of the recording medium M at the conveyance start position for the first time, the placeable range is normally a first placeable range in which the recording medium M is not placed. When an image is recorded in an image recording range during a second lap of the conveyance with the ink ejected from the head unit 23 (image recording step), the recording medium M is discharged to the medium discharger 30 via the deliverer 25.

When images are recorded on both sides, as illustrated in FIG. 4B, the recording medium M is placed at a position again, five behind a placement position for an initial non-recording turn, and an image is recorded on the front surface of the recording medium M, and then the recording medium M is placed at a position, five behind the position, and an image is recorded on a back surface thereof. In this case, the timing when the recording medium reaches the placement positon related to recording on the back surface overlaps the timing when the recording medium M is initially fed to be heated. Specifically, the placeable range related to the operation of recording on a back surface of a first recording medium M overlaps a non-recording turn of a sixth recording medium M.

Here, after five recording mediums M are fed every other time for a non-recording turn, the feeding of the recording mediums M is interrupted, and the sixth recording medium M is fed to a placeable range, two behind the placeable range at the time of the completion of recording on the front side of the fifth recording medium M, namely, a placeable range, seven behind the placeable range at the feeding of the fifth recording mediums M, and subsequently, seventh to tenth recording mediums M are fed every other time. Due to such a supply pattern of the recording mediums M, the recorded images are output without skip of the placeable ranges.

Figure 5:
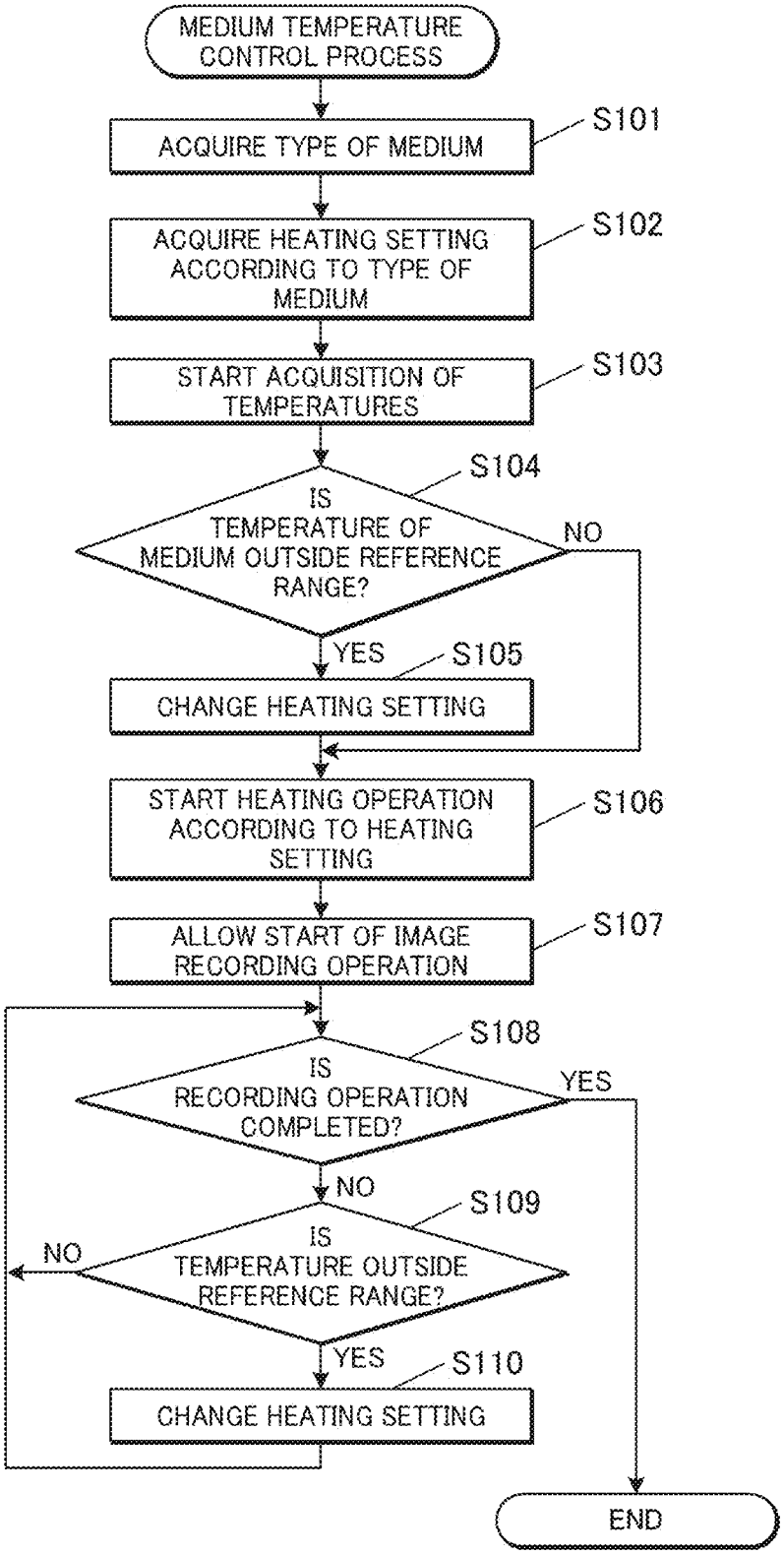
FIG. 5 is a flowchart illustrating a control procedure of a medium temperature control process.

FIG. 5 is a flowchart illustrating a control procedure by the hardware processor 40 in the medium temperature control process executed in the ink jet recording device 1 of the present embodiment.

The process includes a recording medium temperature control method of the present embodiment, and is started in parallel to a control process related to an image recording operation when job data including an image recording operation command is acquired. Alternatively, the process may be called to and started inside a process related to the image recording operation.

When the medium temperature control process is started, the hardware processor 40 (CPU 401) acquires the type of a medium from job data (step S101). The hardware processor 40 acquires a heating setting according to the type of the medium with reference to the heating setting 403*a* (step S102).

The hardware processor 40 starts acquiring temperature data of each part from the temperature meter 65 (step S103). When temperature data is periodically acquired from the temperature meter 65 without starting acquisition, the process of step S103 may be omitted. Alternatively, in the process of step S103, the interval for acquisition of temperature data may be adjusted (for example, changed to be narrow).

The hardware processor 40 determines whether or not the pre-feeding temperature of the recording medium M measured by the feed temperature meter 12 is outside a reference temperature range (step S104). When it is determined that the pre-feeding temperature is outside the reference temperature range ("YES" in step S104), the hardware processor 40 changes the acquired heating setting according to the degree of deviation from the reference (step S105). Then, the process of the hardware processor 40 proceeds to step S106.

When it is determined that the temperature of the medium is not outside the reference temperature range (in the reference temperature range) ("NO" in step S104), the process of the hardware processor 40 proceeds to step S106.

When the process proceeds to the process of step S106, the hardware processor 40 starts a heating operation according to the heating setting (step S106). The hardware processor 40 causes the drum heater 271 and, if necessary, the forward heater 222 to operate via the heating controller 46. When the temperature caused by the drum heater 271 exceeds a reference temperature, or when a predetermined time from the start of the operation has elapsed, the hardware processor 40 allows the start of the image recording operation (step S107). As described above, the image recording operation may be controlled in a separate image recording control process. In the image recording control process, as illustrated in FIG. 4A and FIG. 4B, a case where non-recording turns are performed (temperature regulation step), a case where an image is recorded on the front surface, and a case where an image is recorded on the back surface (collectively an image recording step) are switched in order.

The hardware processor 40 determines whether or not the recording operation is entirely completed (step S108). When it is determined that the recording operation is not completed ("NO" in step S108), the hardware processor 40 determines whether or not one of the measured temperatures obtained from the temperature meter 65 is outside a reference temperature range (step S109). The reference temperature range may be the same as or different from the reference temperature range used in the determination process of step S104. When it is determined that there is no measured temperature outside the reference temperature range ("NO" in step S109), the process of the hardware processor 40 returns to step S108.

When it is determined that there is a measured temperature outside the reference temperature range ("YES" in step S109), the hardware processor 40 appropriately changes the heating setting according to the measurement position indicated by the temperature outside the reference temperature range (step S110). Since the heat accumulation is faster than the heat dissipation by the continuation of the image recording operation in many cases, and the temperature of each part is likely to rise, the main change is to pause a part or the entirety of the heating operation in many cases. When the temperature of the image recording drum 21 excessively rises, the fan 272 may be operated to switch to the heat dissipation. Then, the process of the hardware processor 40 returns to step S108.

In the process of step S108, when the recording operation is entirely completed ("YES" in step S108), the hardware processor ends the medium temperature control process.

The operation of each part of the temperature regulator 60 may be entirely stopped at the same time when the medium temperature control process ends, or each part may maintain heating for a predetermined time or stand by at a value slightly higher than room temperature in consideration of a case where another subsequent job is executed.

As described above, the ink jet recording device 1 of the present embodiment includes the conveyor (the image recording drum 21 and the delivery drum 221) that conveys the recording medium M; the head units 23 that eject the ink to cause the ink to land on the recording medium M in the middle of the conveyance path of the recording medium M conveyed by the conveyor (image recording drum 21); the reverser 26 that returns the recording medium M from the first position downstream of the landing position of the ink, which is ejected from the recording operator, to the position upstream thereof along the conveyance path; the main temperature regulator 27 that regulates the temperature of the recording medium in at least a part of the region from the second position to the ink landing position on the conveyance path; and the hardware processor 40. The hardware processor 40 causes the head unit 23 not to eject the ink while the recording medium M initially passes through the ink landing position.

In such a manner, the recording medium M is continuously placed and heated to be kept warm during one lap of the movement without an image recorded thereon, so that the temperature of the recording medium M gets close to the temperature of the outer peripheral surface of the image recording drum 21. Therefore, with the normal configuration, the temperature of the recording medium M can be set to an appropriate temperature without increasing the maximum amount of heating of the main temperature regulator 27, and the landed ink can be properly fixed. Accordingly, the ink jet recording device 1 can conveniently and flexibly obtain a proper image on the recording medium M. Particularly, in order to adjust a temporarily large deviation from the target temperature, for example, immediately after the start of the image recording operation, it is not required to spend high cost on or increase the size of the main temperature regulator 27.

The hardware processor 40 causes the head unit 23 not to eject the ink onto the recording medium M for a predetermined number of times according to the characteristic of the recording medium M until the recording medium is returned from the first position to the second position by the reverser 26. Namely, for the recording medium M of which the temperature is quite difficult to be changed to an appropriate temperature, the number of non-recording turns can be increased according to the characteristic of the recording medium M to postpone the recording operation until the appropriate temperature is reached. Accordingly, the ink can be landed on and fixed to the recording medium M at the appropriate temperature only by easy control without greatly improving the performance of the configurations related to heating and the like.

The predetermined number of times is determined by using at least one of the thickness and the type of the recording medium M and the pre-feeding temperature of the recording medium M as a setting condition. Namely, since at least one of the three parameters which greatly affect heating is used, the image recording operation and the fixing operation can be performed in a stage where an appropriate temperature is more reliably reached.

The ink jet recording device 1 includes the temperature meter 65 that measures the temperature at a predetermined position of the host machine. The hardware processor 40 determines the predetermined number of times related to non-recording turns based on the temperature measured by the temperature meter 65. The amount of heating can be adjusted in substantially real time in consideration of an effect such as a rise in temperature caused by the recording operation by also measuring and reflecting a change in temperature or the like during recording operation in addition to the pre-feeding temperature of the recording medium M. Therefore, when the non-recording turn is not required in the middle of operation, the heating operation can be flexibly changed to efficiently maintain an appropriate temperature of the recording medium M.

The conveyor includes the image recording drum 21 that moves the placement surface, on which the recording medium M is placed, along the conveyance path. The reverser 26 returns the recording medium M from the first position to the second position on the outer peripheral surface of the image recording drum 21, and the main temperature regulator 27 regulates the temperature of the outer peripheral surface of the image recording drum 21. Namely, since the recording medium M is not directly heated, but the image recording drum 21 having a larger heat capacity than that of the recording medium M is adjusted to a desired temperature, the temperature of the recording medium M is easily and stably held at a desired temperature. Since the temperature adjustment is continued while the recording medium M is present on the outer peripheral surface, the temperature adjustment during non-recording turn has a larger effect than heating only at the heating position of the recording medium M.

The conveyor includes the delivery drum 221 (second placement member) that is located upstream of the second position on the conveyance path to place the recording medium M, and includes the forwarder 22 that delivers the recording medium M to the image recording drum 21, and the forward heater 222 that regulates the temperature of the delivery drum 221. Since the delivery drum 221 can also be heated in such a manner, the heating can be easily put into end without greatly increasing the number of non-recording turns, so that the output efficiency of images is not greatly reduced.

The hardware processor 40 controls the operation of the forward heater 222 according to the characteristic of the recording medium M. Similar to the main temperature regulator 27, since the amount of heating is adjusted according to the characteristic of the recording medium M, the temperature of the recording medium M can be more appropriately adjusted to a temperature appropriate for the image recording operation and the fixing.

The characteristic includes at least one of the thickness, the type, and the pre-feeding temperature of the recording medium M. Since at least one of the three parameters which greatly affect heating is used, the image recording operation and the fixing operation can be performed in a stage where an appropriate temperature is more reliably reached.

The ink jet recording device 1 includes the irradiator 24 that irradiates the recording medium with ultraviolet rays (energy rays), which fix the ink, at the position downstream of the ink landing position and upstream of the first position on the conveyance path. The hardware processor 40 controls the irradiation of the recording medium M, on which the ink has not landed, with ultraviolet rays according to the characteristic of the recording medium M. Since the amount of heat generated by the operation of the irradiator 24 is larger than those generated by other configurations, when normal heating by the temperature regulator 60 is insufficient, the irradiator 24 can be included as a part of the heaters, and the irradiator 24 can be operated in a situation where the ink is not ejected and the fixing operation is not affected. Accordingly, with the configuration in the related art, the amount of heating can be increased without increasing the capacity of the drum heater 271 or increasing the number of non-recording turns.

Predetermined energy rays are ultraviolet rays. Namely, the energy beams may be widely used for heating in the ink jet recording device 1 in which a UV curable ink is used.

The recording medium temperature control method of the ink jet recording device 1 of the present embodiment includes the temperature regulation step of causing the head unit 23 not to eject the ink while the recording medium initially passes through the ink landing position.

The temperature of the recording medium during image recording can be appropriately controlled more conveniently and flexibly by such a recording medium temperature control method.

The invention is not limited to the above embodiment, and can be changed in various forms.

For example, in the above embodiment, the image recording drum 21 as the first placement member has been described as being single, but is not limited thereto. The recording medium may be delivered and moved among a plurality of placement members. In this case, the heating of the plurality of placement members may be controlled in common, or the heating may be individually controllable.

In the above embodiment, the heating settings of five stages have been provided as an example, but are not limited thereto. The order may be appropriately changed and set according to a priority such as the electric power consumption of each part or the output efficiency of images. The order of the settings may be manually changeable by an operation or the like that is input to the operation interface 71 by a user. The heating method may not be limited to that illustrated in the present embodiment. For example, the conveyance speed of the medium may be finely adjusted.

In the above embodiment, the image recording drum 21 and the delivery drum 221 have been described as being heated by infrared rays or the like from outside, but may be heated from inside. Even in this case, the configuration related to heating may be separated from the rotation of the image recording drum 21 and the delivery drum 221.

In the above embodiment, heating by the forwarder 22 has been described as being performed, but may not be performed. Alternatively, instead of heating by the delivery drum 221, a space for pre-heating may be separately prepared between the medium feeder 10 and the image recording drum 21.

In the above embodiment, the temperature is measured at five locations by the feed temperature meter 12, the forward temperature meter 223, the drum temperature meter 281, the pre-recording temperature meter 282, and the post-recording temperature meter 283; however, the invention is not limited thereto. A part of the above temperature meters may be omitted, or the temperature may be measured elsewhere. In a case where the temperature is assumed to be substantially stable after an initial rise in temperature, or the like, the above control may not be performed in substantially real time to the extent of corresponding to emergency.

In the above embodiment, the recording medium M which is placed, conveyed, and heated on the outer peripheral surface of the image recording drum 21 having a cylindrical shape has been described as an example; however, the invention is not limited thereto. The recording medium may be placed on a conveyance belt moving on platens or the like, and moved and heated on a flat surface. Alternatively, the invention may not be limited to a configuration in which the temperature of the outer peripheral surface or a placement member such as the conveyance belt is regulated to adjust the temperature of the recording medium M. The recording medium M may be directly heated by infrared rays or the like. In this case, the recording medium M may not be limited to being placed and conveyed on the placement surface. The ink jet recording device 1 may include a conveyor that delivers the recording medium by using rollers or the like.

In the above embodiment, the reverser 26 has been described as reversing the front and back sides of the recording medium M and returning the recording medium M to the upstream side of the landing position; however, in an ink jet recording device that does not record images on both sides, the recording medium may be simply returned in a state where the same surface remains as the target recording surface without the front and back sides being reversed. In this case, the recording medium M may not be separated once from the outer peripheral surface of the image recording drum 21 as long as the configuration does not affect the heating of the image recording drum 21. Even when images are recorded on a single side at a plurality of times in an overlapping manner, similarly, the recording medium may be returned without being reversed.

In the above embodiment, the irradiator 24 has been described as being used as an auxiliary for heating when a UV curable ink is irradiated with UV rays; however, the ink is not limited to the UV curable ink, and a configuration related to the fixing operation, or the like may be adopted which corresponds to other inks or the ink. For example, a dryer or the like which evaporates moisture of the ink may be used for heating. Such auxiliary heating may not be performed at all.

In the above embodiment, the configuration has been described in which heat dissipation is promoted by the fan 272 in the case of excessive heating; however, the invention is not limited to the fan as a configuration of decreasing the temperature, and for example, water cooling or the like may be used. Meanwhile, when it is not required to lower the temperature, the main temperature regulator 27 may not include the fan 272 or the like.

The feeding pattern of the recording medium M, a time lag due to reversal, or the like is not limited to that illustrated in the embodiment, and may be appropriately designed and set. The ink jet recording device is not limited to a piezoelectric type, and may be another type.

The specific configurations, the content and the procedure of the process operation, and the like illustrated in the above embodiment can be appropriately changed without departing from the concept of the invention. The scope of the invention includes the scope of the invention described in the claims and equivalent scopes.

Although embodiments of the present invention have been described and illustrated in detail, the disclosed embodiments are made for purposes of illustration and example only and not limitation. The scope of the present invention should be interpreted by terms of the appended claims.

What is claimed is:

1. An ink jet recording device comprising:

a conveyor that conveys a recording medium;

a recording operator that ejects an ink to cause the ink to land on the recording medium in a middle of a conveyance path of the recording medium conveyed by the conveyor;

a reverser that returns the recording medium from a first position downstream of a landing position of the ink, which is ejected from the recording operator, to a second position upstream of the landing position along the conveyance path;

a first temperature regulator that regulates a temperature of the recording medium in at least a part of a region from the second position to the landing position on the conveyance path; and a hardware processor, wherein the hardware processor causes the recording operator not to eject the ink while the recording medium initially passes through the landing position.

2. The ink jet recording device according to claim 1, wherein the hardware processor causes the recording operator not to eject the ink onto the recording medium for a predetermined number of times according to a characteristic of the recording medium until the recording medium is returned from the first position to the second position by the reverser.

3. The ink jet recording device according to claim 2, wherein the predetermined number of times is determined using at least one of a thickness and a type of the recording medium and a pre-feeding temperature of the recording medium as a setting condition.

4. The ink jet recording device according to claim 2, further comprising:

a meter that measures a temperature at a predetermined position of the ink jet recording device, wherein, the hardware processor determines the predetermined number of times based on the temperature measured by the meter.

5. The ink jet recording device according to claim 1, wherein, the conveyor includes a first placement member that moves a placement surface, on which the recording medium is placed, along the conveyance path, the reverser returns the recording medium from the first position to the second position on the first placement member, and the first temperature regulator regulates a temperature of a front surface of the first placement member.

6. The ink jet recording device according to claim 1, wherein, the conveyor includes a forwarder including a second placement member that places the recording medium at a position upstream of the second position on the conveyance path, and a second temperature regulator that regulates a temperature of the second placement member.

7. The ink jet recording device according to claim 6, wherein, the hardware processor controls operation of the second temperature regulator according to a characteristic of the recording medium.

8. The ink jet recording device according to claim 7, wherein, the characteristic includes at least one of a thickness, a type, and a pre-feeding temperature of the recording medium.

9. The ink jet recording device according to claim 1, further comprising:

an irradiator that irradiates the recording medium with predetermined energy rays at a position downstream of the landing position and upstream of the first position on the conveyance path to fix the ink, wherein, the hardware processor controls irradiation of the recording medium, on which the ink has not landed, with the energy rays.

10. The ink jet recording device according to claim 9, wherein the predetermined energy rays are ultraviolet rays.

11. A recording medium temperature control method of an ink jet recording device including a conveyor that conveys a recording medium, a recording operator that ejects an ink to cause the ink to land on the recording medium in a middle of a conveyance path of the recording medium conveyed by the conveyor, a reverser that returns the recording medium from a first position downstream of a landing position of the ink, which is ejected from the recording operator, to a second position upstream of the landing position along the conveyance path, and a first temperature regulator that regulates a temperature of the recording medium in at least a part of a region from the second position to the landing position on the conveyance path, the method comprising:

temperature regulating of causing the recording operator not to eject the ink while the recording medium initially passes through the landing position.

* * * * *